US006659800B1

(12) United States Patent
Wu

(10) Patent No.: US 6,659,800 B1
(45) Date of Patent: Dec. 9, 2003

(54) INTERFACE CONNECTOR FOR PROTECTING AGAINST ELECTROMAGNETIC INTERFERENCE

(76) Inventor: Tung-Hsin Wu, No. 3, Chung Cheng St., Lo-Tung, I-Lan (TW)

( * ) Notice: Subject to any disclaimer, the term of this patent is extended or adjusted under 35 U.S.C. 154(b) by 0 days.

(21) Appl. No.: 10/216,360

(22) Filed: Aug. 12, 2002

(51) Int. Cl.[7] ..... H01R 13/648; H01R 9/22; H01R 13/73

(52) U.S. Cl. ..... 439/607; 439/931

(58) Field of Search ..... 439/607, 610, 439/608, 931, 449, 464

(56) References Cited

U.S. PATENT DOCUMENTS 5,253,318 A * 10/1993 Sayegh et al. ..... 385/114
5,563,497 A * 10/1996 Iwatani et al. ..... 322/99
5,567,175 A * 10/1996 Warden et al. ..... 439/490
6,394,625 B2 * 5/2002 Demaria ..... 362/249
2001/0021602 A1 * 9/2001 Zanten ..... 439/358
2003/0036304 A1 * 2/2003 Soubh ..... 439/493

* cited by examiner

*Primary Examiner*—Chandrika Prasad
(74) *Attorney, Agent, or Firm*—Troxell Law Office PLLC

(57) ABSTRACT

The present invention relates to an interface connector for protecting against electromagnetic interference. The interface connector includes a layer of insulating coating of mylar or other heat-resisting polyester. An elastic flexible portion is formed by wrapping the insulating coating at the center or at least one end thereof. In addition, the layer of insulating coating has metal sputter coating against magnetic discharge. The metal coating after sputtering treatment is uniform in thickness and pore-free so that the impedance of the whole surface is consistent to effectively protect against electromagnetic interference between the external and the self-producing electromagnetic waves. Furthermore, it's not required to wrap the conducting adhesive tape so that the processing procedure can be simplified and the production cost can be reduced.

7 Claims, 2 Drawing Sheets

INTERFACE CONNECTOR FOR PROTECTING AGAINST ELECTROMAGNETIC INTERFERENCE

BACKGROUND OF THE INVENTION

1. Field of the Invention

The present invention relates to an interface connector for protecting against electromagnetic interference, and more particularly, to an interface connector which ensures a tight connection, a stable signal transmission and an effective prevention from electromagnetic interference of external and self-producing magnetic waves.

2. Description of the Prior Art

In all kinds of electric circuit, the circuit board sometimes has to be divided into many sections due to space restriction or other conditions. Signal cables are utilized to connect signals. Especially, flat interface connectors with advantages of saving space and facilitating assembly are widely used in microelectronic devices. However, the problem with electromagnetic interference between the external and self-producing magnetic waves has to be overcome. In addition, all wires of the interface connector are kept away from one another at regular intervals such that the transmission impedance of the interface connector is consistent.

A conventional protection of the interface connector against electromagnetic interference includes a metal protection layer (e.g. conducting adhesive tape) stuck to the surface of the interface connector by means of back glue (e.g. double-sided tape). This metal protection layer serves to protect against the electromagnetic interference. In consideration of cost and other factors, the double-sided tape is often used. However, its adhesion can't meet the requirement to stick the conducting adhesive tape. Moreover, it's not heat-resistant. This kind of glued joint easily fails after use for a longer period. Furthermore, the metal protection layer is sputter-coated to the conducting adhesive tape made of nonwoven material. The nonwoven surface of the conducting adhesive tape has pores so that the protection effect against the electromagnetic interference is very poor. Moreover, the softness of the conducting adhesive tape after sputter coating treatment is also poor so that the flexibility of the interface connector is affected.

Taiwanese Model Utility No. 415692 discloses an interface connector against electromagnetic interference (see FIG. 1). The interface connector includes a metal protection layer 20 formed on the surface of both ends thereof through sputter coating with materials of aluminum and copper. The metal protection layer 20 can also be formed on the PET-film through vapor deposition or sputter coating. Hot melt adhesives 30 are interposed between the metal protection layer 20 and the interface connector 10. Therefore, the metal protection layer 20 is used to protect against the electromagnetic interference. However, this structure has following drawbacks:

1. The hot melt adhesives 30 are easily melted by heating while cracked after being dried. Thus, they are often softened at high temperature or even seep out after being melted. They can also be hardened and cracked after use under high temperature condition so that their sealing effect is lost. Accordingly, the self-producing magnetic waves are discharged, thereby leading to electromagnetic interference with the external electromagnetic waves.
2. The metal protection layer 20 formed through sputter coating or vapor deposition requires coating cost and work hours, thereby leading to a negative effect on cost reduction and competitiveness promotion. Moreover, the flexibility of the interface connector 10 is also affected due to the formation of the metal protection layer 20.
3. The thickness of wrapping layer of PET-film formed by vapor deposition or sputter coating and of the conducting adhesive tape is uneven, thereby leading to uneven impedance and affecting the protection effect against electromagnetic interference.
4. The hot melt adhesives 30 are non-transparent so that the interface connector 10 is easily squeezed during the processing so that it's uneasy to find when the pitch of all signal lines is changed. Accordingly, it affects the smoothness of signal transmission impedance.

SUMMARY OF THE INVENTION

It is a primary object of the present invention to eliminate the aforementioned drawbacks and to provide an interface connector to protect against electromagnetic interference which includes a layer of insulating coating of mylar or other heat-resisting polyester. In addition, the layer of insulating coating has metal sputter coating against magnetic discharge to effectively protect against electromagnetic interference between the external and the self-producing electromagnetic waves. Furthermore, it's not required to wrap the conducting adhesive tape so that the processing procedure can be simplified and the production cost can be reduced.

It is another object of the present invention to provide an interface connector against electromagnetic interference which is required to be cleaned before sputter coating since the mylar material has smooth surface and is pore-free. After sputter coating treatment, the thickness of the metal coating layer is uniform and even smaller than that of the conducting adhesive tape of the prior art. Accordingly, the transmission impedance is consistent, thereby increasing the protection effect against electromagnetic interference.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
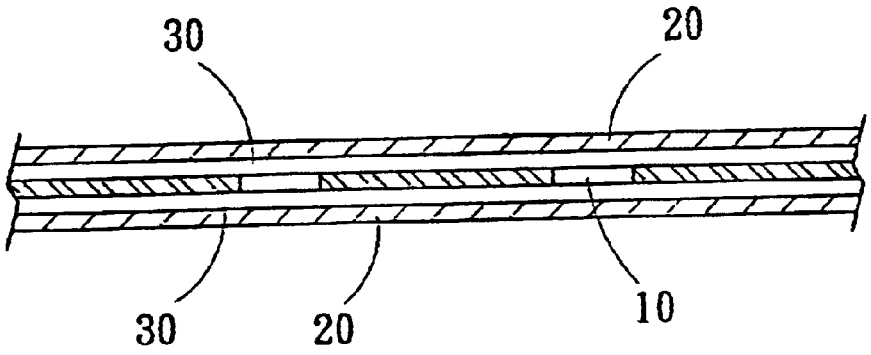
Fig. 1 (Prior Art)
FIG. 1 is a sectional view of TW Pat. No. 415692.
Figure 3:
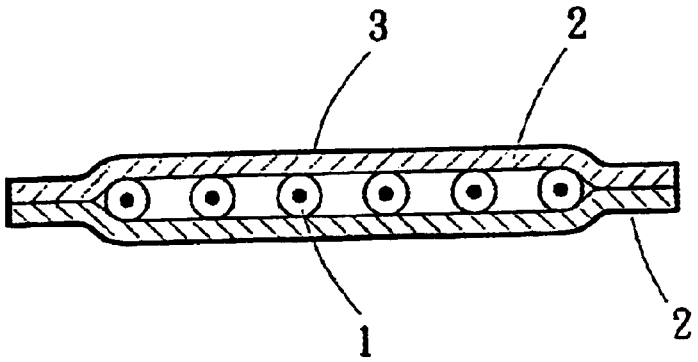
FIG. 3 is sectional view of the present invention

FIG. 1 shows a sectional view of TW Pat. No. 415692. Its configuration and drawbacks have been described above and no further descriptions are given hereinafter.

Figure 2:
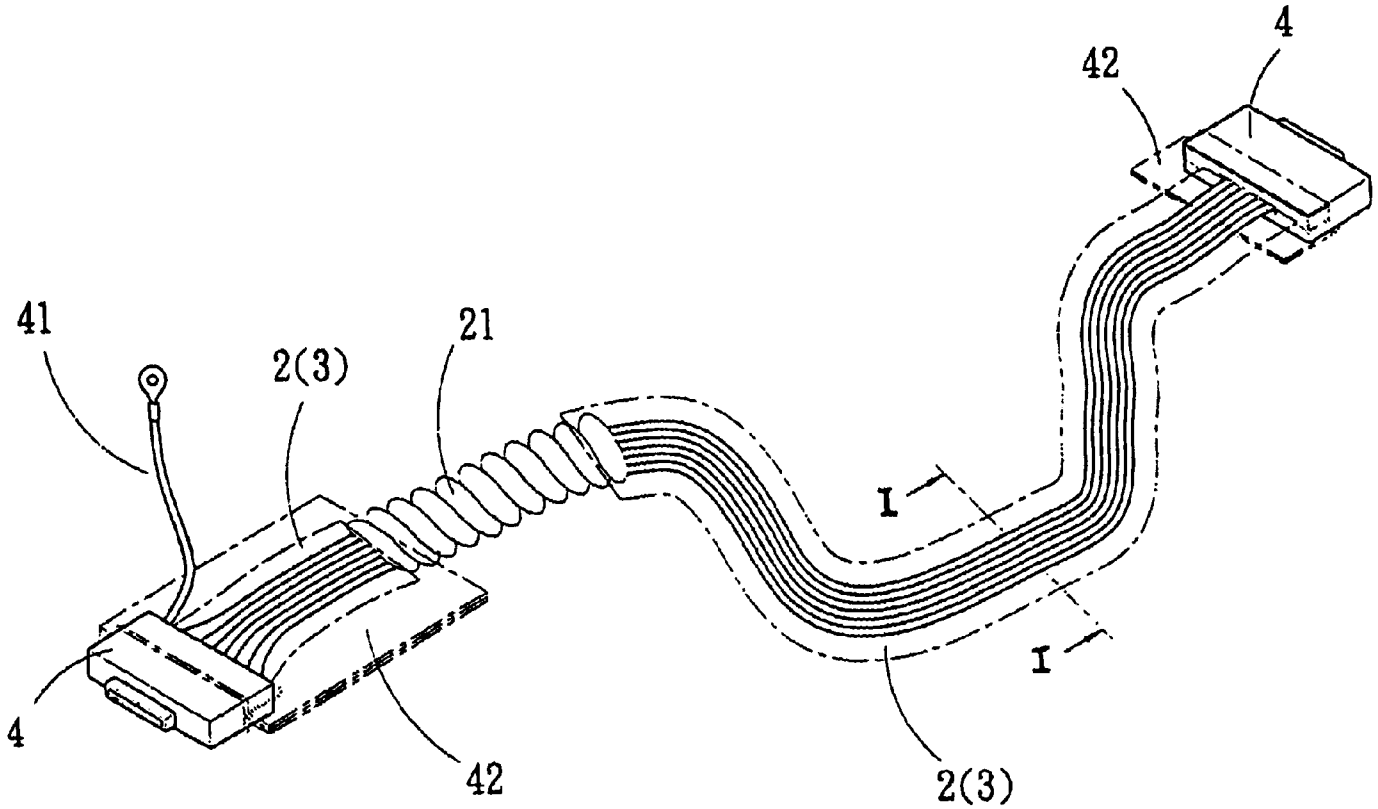
FIG. 2 is a schematic drawing of the structure of the present invention.

FIG. 2 shows a schematic drawing of the structure of the present invention. It's apparent that the present invention includes an interface connector 1, an insulating wrapping layer 2 and a metallic coating layer 3. The interface connector 1 consists of very fine coaxial wires, other Polyethylene Ethylene (PE) PE-wires or very fine wires which are arranged at regular intervals. The insulating wrapping layer 2 is made of mylar or other heat-resistant wrapping material which is wrapped around the interface connector 1 to create protection. The mylar of polyester materials features a transparent, smooth and pore-free surface so that the arrangement of very fine coaxial wires (other PE-wires or very fine wires) of the interface connector 1 on the mylar is visible. In case of being squeezed or uneven arrangement, they can be handled immediately in such a way that the pitch of every coaxial wire is consistent so as to reach a stable transmission impedance or other features. The metallic coating layer 3 is directly sputter-coated to the surface of the insulating wrapping layer 2. Since the metal has anti-magnetic effect, an anti-magnetic insulating protection is produced around the insulating wrapping layer 2.

In addition, an elastic flexible portion 21 is formed by wrapping the insulating wrapping layer around the center or at least one end of the interface connector while the surface of the elastic flexible portion 21 is sputter-coated with a metallic coating layer 3. Thus, the elastic flexible portion 21 is elastic and flexible. This is especially suitable for the interface connector 1 necessarily bending between the main body and the monitor of a laptop computer or between circuit boards. The interface connector 1 is provided with a connector 4 at both ends thereof to produce an electrical connection between two separate circuits. A metal protection piece 42 is disposed on the top surface of the connectors 4. The metal protection piece 42 is connected with a metal ground lead 41 or the other metallic wire which is in combination with the metallic coating layer 3 on the surface of the interface connector 1 to form a total protection against electromagnetic interference between the internal and the external magnetic waves.

Accordingly, the present invention has following advantages: simple configuration, easy processing, lost production cost and full protection against electromagnetic interference between the internal and the external magnetic waves.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An interface connector for protecting against electromagnetic interference comprising:

a) an interface connector;

b) two connectors electrically connected to opposing ends of the interface connector to transmit signals therebetween;

c) a metal protection piece connected to a top of each connector;

d) an insulating wrapping layer formed around the interface connector, the insulating wrapping layer being a transparent and heat resistant polyester material;

e) an elastic flexible portion formed on a pre-determined part of the interface connector; and f) a metallic coating layer sputter-coated on the insulating wrapping layer and the elastic flexible portion, such that an antimagnetic insulation is created.

2. The interface connector for protecting against electromagnetic interference according to claim 1, wherein the interface connector has fine coaxial wires.

3. The interface connector for protecting against electromagnetic interference according to claim 1, wherein the interface connector has fine wires.

4. The interface connector for protecting against electromagnetic interference according to claim 1, wherein the insulating wrapping layer comprises a transparent mylar material.

5. The interface connector for protecting against electromagnetic interference according to claim 1, wherein the pre-determined part on which the elastic flexible portion is formed is selected from a group consisting of the middle part and at least one end of the interface connector.

6. The interface connector for protecting against electromagnetic interference according to claim 1, wherein at least one connector has a ground lead connected to the metal protection piece.

7. The interface connectors for protecting against electromagnetic interference according to claim 1, wherein at least one connector has a ground lead connected to the metal protection piece, and the metal protection piece is connected to the metallic coating layer on the interface connector.

* * * * *